US009342093B2

(12) United States Patent
Villarreal et al.

(10) Patent No.: US 9,342,093 B2
(45) Date of Patent: May 17, 2016

(54) TOOL CARRIER FOR SETTING UP AND PLACING A TOOL FOR A LOADER, AND METHOD FOR SETTING UP AND PLACING A TOOL

(71) Applicant: Deere & Company, Moline, IL (US)

(72) Inventors: Diego Adrian Villarreal, Guadalupe (MX); Damien Faivre, Apremont (FR)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 14/735,427

(22) Filed: Jun. 10, 2015

(65) Prior Publication Data

US 2016/0033989 A1 Feb. 4, 2016

(30) Foreign Application Priority Data

Aug. 4, 2014 (DE) ..... 10 2014 215 330

(51) Int. Cl.
*E02F 3/36* (2006.01)
*G05G 5/08* (2006.01)

(52) U.S. Cl.
CPC ..... *G05G 5/08* (2013.01); *E02F 3/3631* (2013.01); *E02F 3/3636* (2013.01); *E02F 3/3672* (2013.01)

(58) Field of Classification Search
CPC ..... E02F 3/3672; E02F 3/3636; E02F 3/3631
See application file for complete search history.

(56) References Cited

U.S. PATENT DOCUMENTS

| | | | | |
|---|---|---|---|---|
| 5,078,569 | A * | 1/1992 | Cook | E02F 3/3636 414/723 |
| 7,674,085 | B2 | 3/2010 | Bystrom | |
| 8,777,546 | B2 * | 7/2014 | Lanting | E02F 3/96 414/723 |
| 2012/0189374 | A1 * | 7/2012 | Lanting | E02F 3/3672 403/27 |
| 2015/0068073 | A1 * | 3/2015 | Martin | E02F 3/3636 37/195 |

FOREIGN PATENT DOCUMENTS

| | | | |
|---|---|---|---|
| DE | 4327942 | C1 | 1/1995 |
| EP | 1306489 | A1 | 5/2003 |
| WO | 2012085418 | A1 | 6/2012 |

OTHER PUBLICATIONS

German Search Report issued in counterpart application No. 10 2014 215 330.1, dated Mar. 9, 2015 (7 pages).

* cited by examiner

*Primary Examiner* — Gerald McClain

(57) ABSTRACT

The tool carrier disclosed herein has a locking device with a low degree of complexity, a low diversity of parts, and a high degree of reliability. By the completely automated locking process, the setting up of the tool on the tool carrier is considerably simplified for the operator or the driver, since neither has to leave the cabin any longer in order to lock the tool. The actuation of the setting up and holding devices by the tool during the setting up of the tool ensures that the locking device is used only if a tool is also set up. An erroneous movement of the lock into its locking position due to vibrations or by a movement of the tool carrier or the front loader without a set-up tool is effectively avoided.

10 Claims, 12 Drawing Sheets

TOOL CARRIER FOR SETTING UP AND PLACING A TOOL FOR A LOADER, AND METHOD FOR SETTING UP AND PLACING A TOOL

TECHNICAL FIELD

The tool carrier (18) disclosed herein has a locking device (46) with a low degree of complexity, a low diversity of parts, and a high degree of reliability. By means of the completely automated locking process, the setting up of the tool (21) on the tool carrier (18) is considerably simplified for the operator or the driver, since neither has to leave the cabin any longer in order to lock the tool. The actuation of the setting up and holding device (50) by the tool (21) during the setting up of the tool (21) ensures that the locking device (46) is used only if a tool (21) is also set up. An erroneous movement of the locking device into its locking position due to vibrations or by a movement of the tool carrier (18) or the front loader (14) without a set-up tool is effectively avoided.

BACKGROUND

Methods are known for equipping loading vehicles or loaders, in particular, front loaders for use on agricultural tractors, but also construction vehicles such as wheeled loaders or also telescopic loaders with different tools. Thus, for example, it is possible to use forklifts, lances, grippers, or scoops as loading tools. The tools are usually connected to so-called tool carriers or held by them with corresponding holding devices. The tool carriers are thereby usually firmly connected with the front end of the swing arm or the boom of the loading vehicle, wherein the holding devices, constructed on the tool carriers, are an interface to the tool and make it possible for the tools, on the one hand, to be interchangeable or replaceable and, on the other hand however, to be connected also with the tool carrier in an appropriately secured manner. The holding devices thereby usually have tool holders on which the corresponding tool is set up and a lock with which the tool is locked on the tool carrier after it has been set up. Such locking devices known from the state of the art are, as a rule, cumbersome and expensive.

In view of this, the fundamental goal is to propose a solution with a simple and low-cost locking device that is an alternative to that given by the state of the art for a tool carrier.

SUMMARY

The lock for a tool carrier disclosed here has a locking device with a low degree of complexity, a low diversity of parts, and a high degree of reliability. The automated setting up of the tool on the tool carrier is considerably simplified for the operator or the driver, since neither has to leave the cabin any longer in order to lock the tool. This means a savings in time. The simple structure of the locking device and the low diversity of parts facilitate the installation in production and thus contribute also to the reduction of costs. The actuation of the setting up and holding devices by the tool during the setting up of the tool ensures that the lock is activated only if a tool is also set up. An erroneous movement of the lock into its locking position due to vibrations or by a movement of the tool carrier or the front loader without a set-up tool is effectively avoided.

The lock can be accessible via a handle which is located on the tool carrier or which extends outwards on one side of the tool carrier. By pulling on the handle, the lock can be moved out of its locking position. By a subsequent slight turning of the handle, the handle is then brought into its unlocking position, in which the lock is supported on the tool carrier frame.

The lock can be pre-tensioned transversely with a spring. The spring can, for example, be designed as a coil spring which is supported on a rod-shaped area of the lock. The coil spring is preferably supported on one side, against a stop fixed on the lock, and on the other side, against the tool carrier frame, so that with a transversal movement of the lock (that is, with a movement of the lock to one side of the tool carrier), the coil spring is compressed and a pretension force is generated. The coil spring and the stop are designed and situated in such a way that the coil spring does not have a pretension in the locking position, or has only a minimal one, and has its maximum pretension in the unlocking position.

The locking device can be formed in such a way that on the handle side, it has a setting up and holding section and a first guiding and locking section oriented parallel to it. To this end, the lock can have rod sections on the handle side which are oriented parallel to one another and which are connected with one another, via a crosslink, on the ends on the handle side and are maintained at a specific distance to one another.

Furthermore, on the side opposite to the handle, the lock has a second guiding and locking section which aligns transversely to the first guiding and locking section. The lock can, for example, be formed in such a way that the setting up and holding section on the handle end has a correspondingly bent course, as it proceeds to the opposite of the tool carrier, so that the two open ends of the lock jointly point in one direction and are aligned with one another.

The setting up and holding devices comprise a first rotary lever and a second rotary lever, which are supported on a common rotation axle, so as to be nonrotatable relative to one another, wherein the first and second rotary levers can be swiveled by engaging a tool. The setting up and holding devices are accordingly formed by two rotary levers which extend from a rotation axle, wherein the rotation axle is supported in the area of a lower connection site for the tool on the tool carrier frame or in an area in which a fastening lug, which is formed on the tool and through which the lock is pushed in order to connect with the tool carrier frame, protrudes or projects. For example, one rotary lever can function as a kind of trigger and can be deflected or activated and thus swiveled by the fastening lug protruding into the tool frame when the tool is set up. The resulting rotary movement of the rotation axle is correspondingly transferred to the second rotary lever so that the second rotary lever engages with the setting up and holding section of the lock. The first rotary lever is thereby equipped with a longer lever arm than the second rotary lever, since the former must extend into the guiding and locking section of the lock, with which the fastening lug of the tool is locked after the setting up is carried out; on the other hand, the second rotary lever extends only to the setting up and holding section of the lock, which is located closer to the rotation axle.

In addition, a spring is provided which is connected with the tool carrier frame and preferably, with one of the rotary levers. Here, it is also possible to use a spring that is connected with the rotation axle. It is essential that a spring pretension be created during a deflection of the first rotary lever by the fastening lug, so that when the fastening lug is removed from the engagement area, the setting up and holding devices (first and second rotary levers) act, under pretension, against the setting up and holding section of the lock or engage with it under pretension.

The tool holder of the type described above is particularly suitable for use on a loader, such as a front loader or a wheeled loader, in which, in particular, a frequent changing of the tool for different loading tasks is required.

A corresponding method for the setting up and placing of a tool on a tool holder of a loader makes provision for a tool carrier to comprise a tool carrier frame and a locking device located on the tool carrier, with which a tool is locked or will be locked on the tool carrier by a transversely movable lock. The lock is moved, for the placing of the tool, from a locking position into a transversely spring pre-tensioned locking position, in which the lock is supported on the tool carrier frame or is brought there to a stop, wherein the locking device comprises the setting up and holding devices mentioned above, which were brought to a spring-pretensioned position during the setting up of the tool on the tool carrier. During the placing of the unlocked tool by the tool carrier, the setting up and holding devices are released by the fastening lug of the tool, so that the setting up and holding devices under pretension move against the lock and the lock is then released from its unlocking position supported on the tool carrier frame as a result of the spring force of the setting up and holding devices acting on it. In this interaction, the setting up and holding devices assume a holding position and the lock is moved from its unlocking position into a transversely spring pre-tensioned pre-locking position. In this pre-locking position, the lock is no longer supported, as before, on the tool carrier frame, but rather on the setting up and holding devices. With a renewed setting up of a tool, the setting up and holding devices are again deflected by the fastening lug constructed on the tool and brought from the holding position into the previously mentioned, spring pre-tensioned position. Since the lock is located, in the meantime, in its locking position and is supported on the setting up and holding devices and not as in the unlocking position, on the tool carrier frame, the holding function of the setting up and holding devices is cancelled and the lock is released, so that the released lock is brought from the pre-locking position into the locking position by transversal spring force.

With the aid of the drawing which shows an embodiment example of the invention, the invention and other advantages and advantageous refinements and developments of the invention are described and explained in more detail below.

DETAILED DESCRIPTION OF THE DRAWINGS

Figure 1:
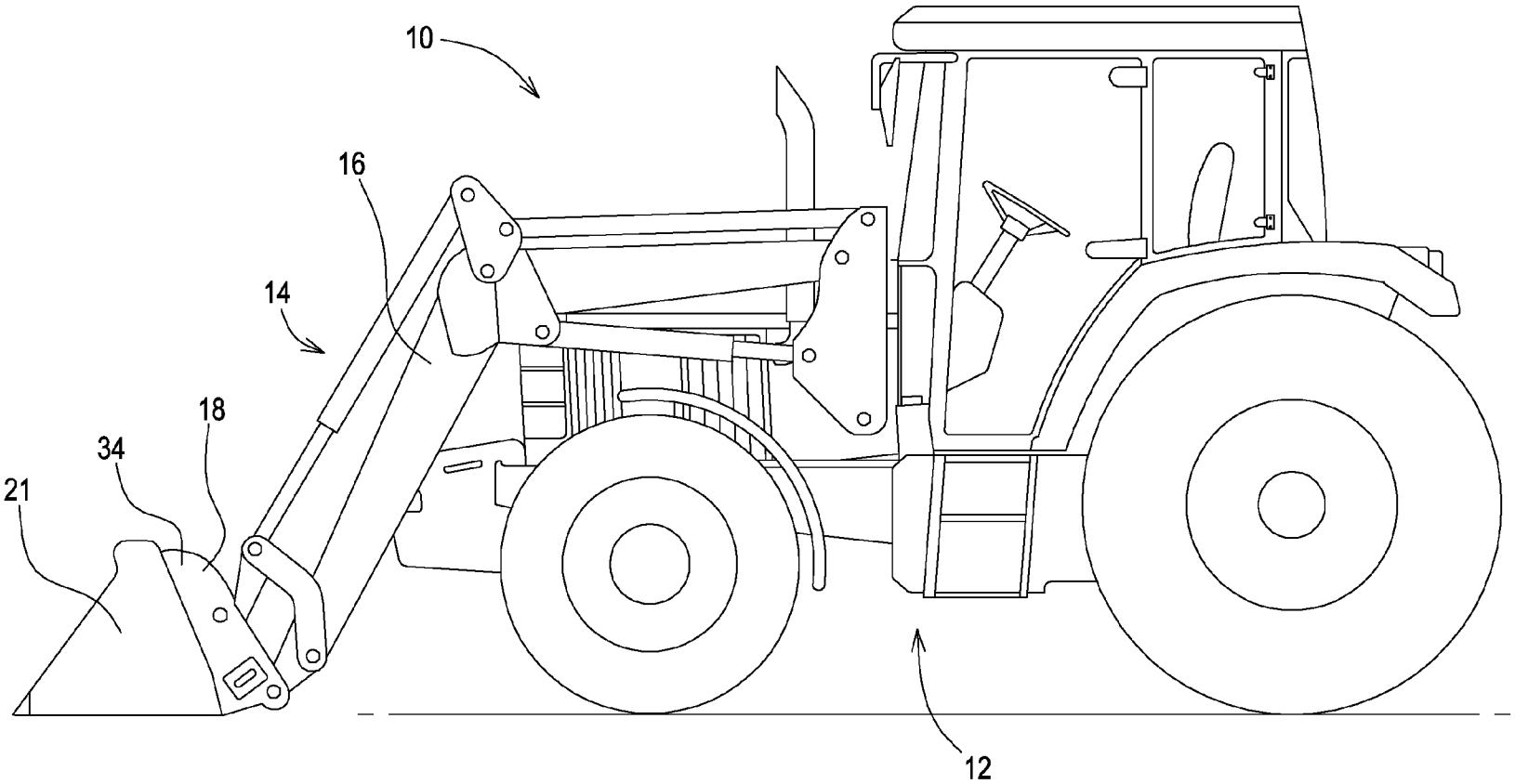
FIG. 1 is a schematic side view of an agricultural vehicle with a front loader and with a tool carrier located on the front loader.

FIG. 1 shows a loading vehicle 10 or loader in the form of an agricultural tractor 12 with a front loader 14. The front loader 14 has two loading swing arms 16 which are coupled on the tractor 12 and which extend forwards in the longitudinal direction of the tractor 12. On the front end of the loading swing arms 16, there extends, in the transverse direction to the loading swing arms 16, a tool carrier 18, wherein tool holding areas 20, 20' are designed on the tool carrier 18, in which a tool 21 in the form of a loading scoop is suspended and locked.

The tool carrier 18 and the related details are explained below, with the aid of FIGS. 2 and 4 to 12.

Figure 2:
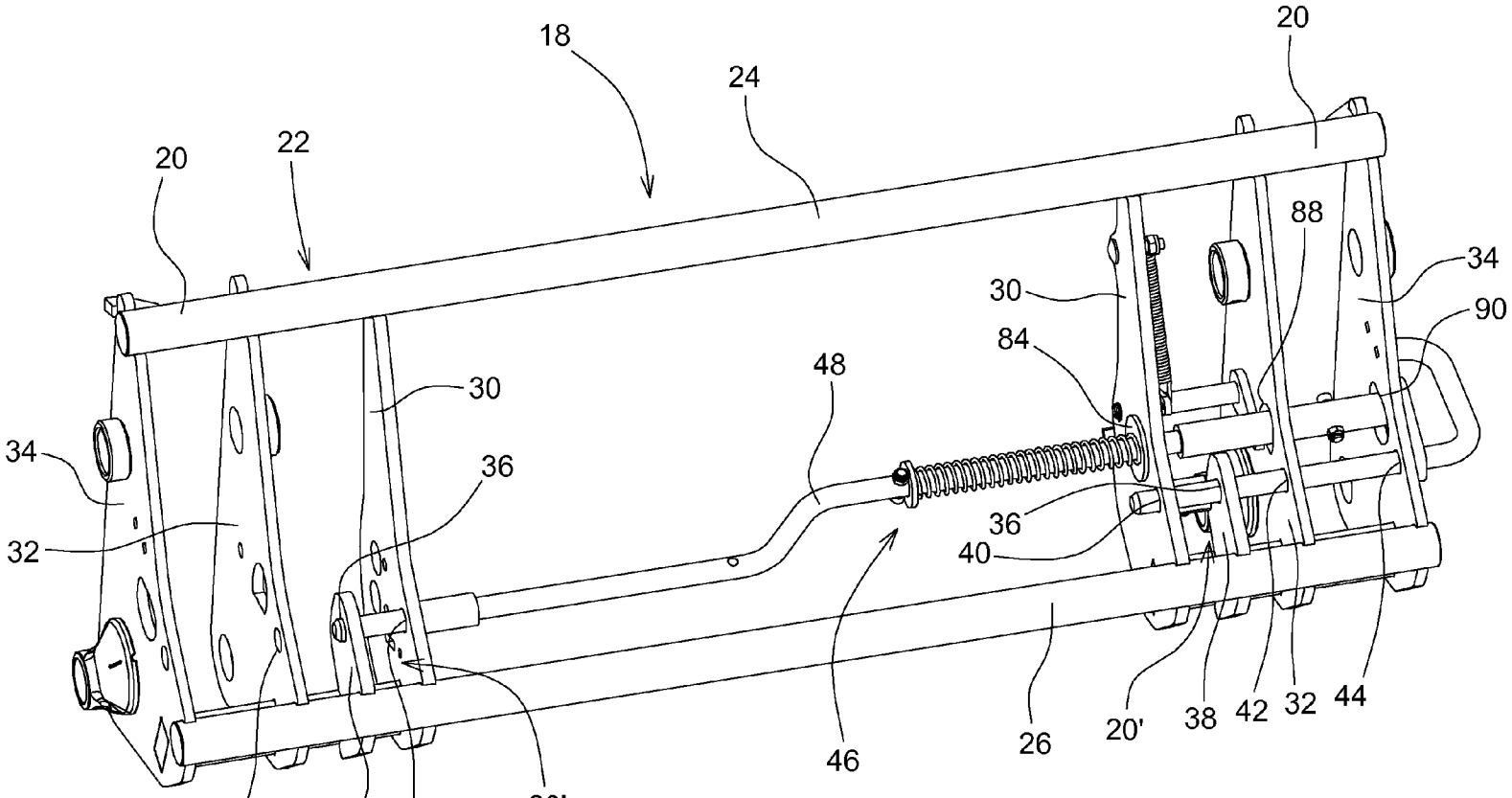
FIG. 2 is a schematic perspective front view of the tool carrier from FIG. 1.
Figure 3:
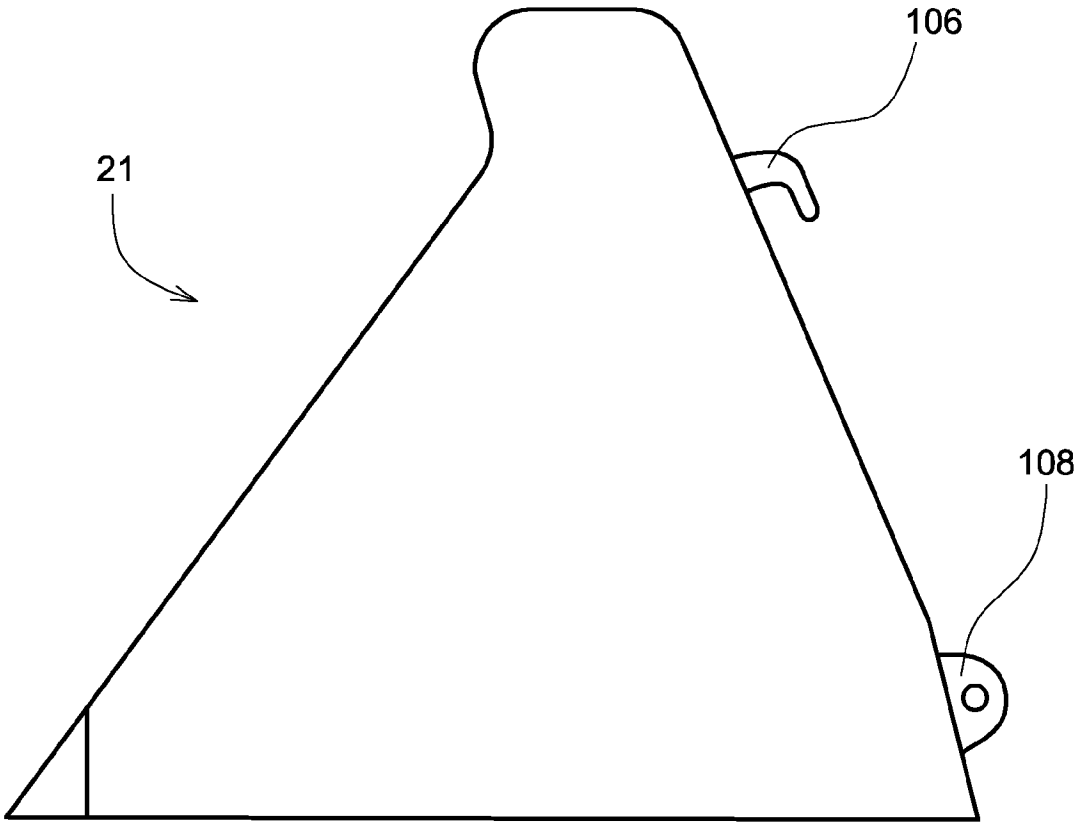
FIG. 3 is a schematic side view of a tool for the tool carrier from FIGS. 1 and 2.

The tool carrier 18 comprises a tool carrier frame 22 which was produced in a welded construction and which can be seen in detail in FIG. 2. The tool carrier frame comprises an upper cross brace 24 and a lower cross brace 26. The cross braces 24 and 26 are connected with one another by profile plates 30, 32, 34 aligned vertically and in the longitudinal direction, which are, in accordance with the lower cross brace 26, arranged on both sides of the tool carrier or symmetrical to the center of the tool carrier. Furthermore, support plates 38, which are provided with a borehole 36, are present; they are used together with other boreholes 40, 42, 44, formed in the profile plates 30, 32, 34, to support and guide a locking device 46.

Figure 8:
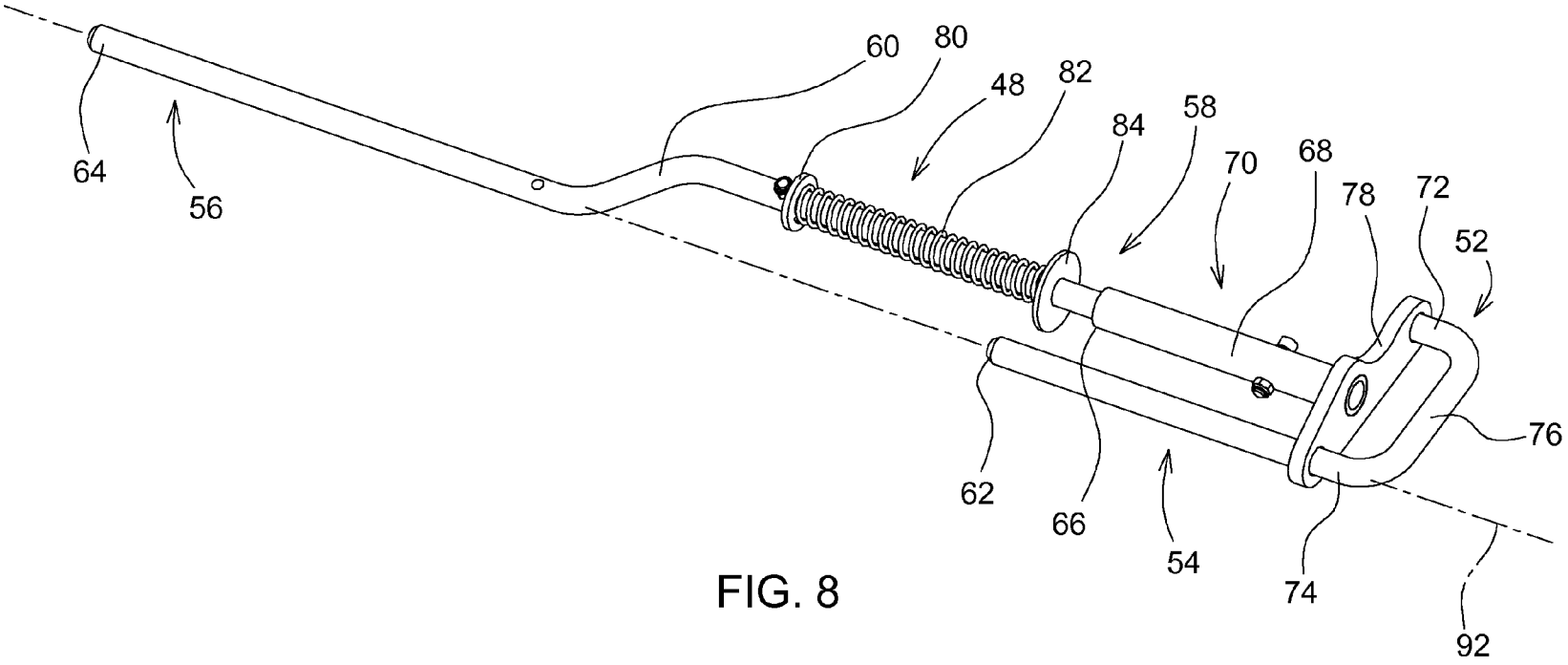
FIG. 8 is a schematic, perspective view of a lock of the locking device from FIGS. 4 to 7.
Figure 9:
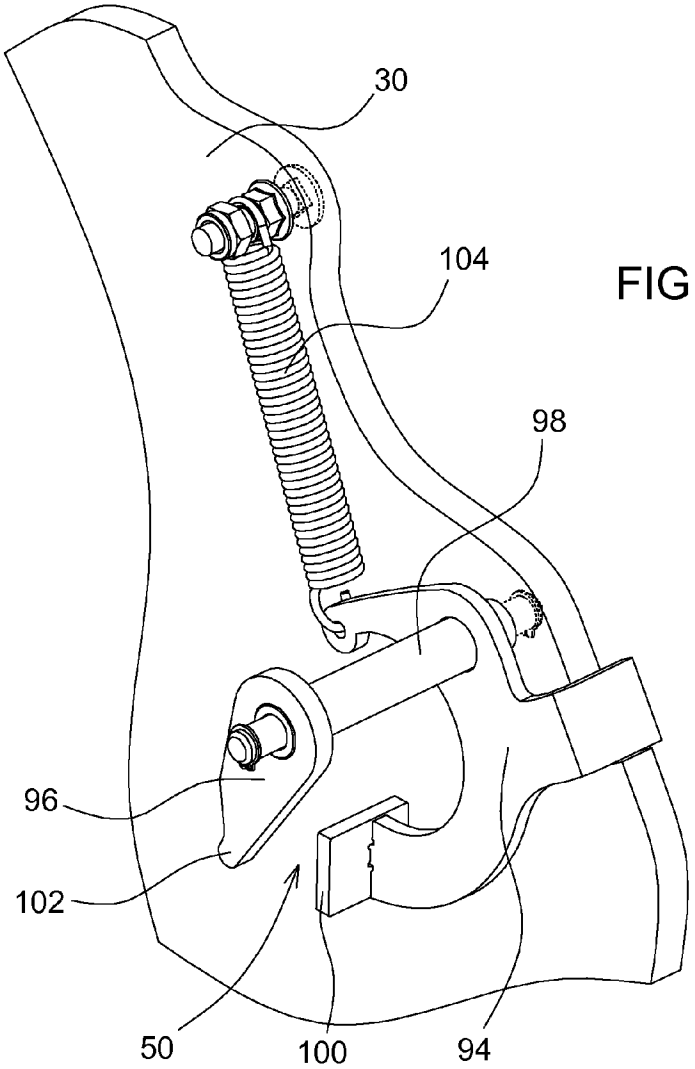
FIG. 9 is a schematic, perspective view of the setting up and holding devices of the locking device from FIGS. 4 to 7.
Figure 10:
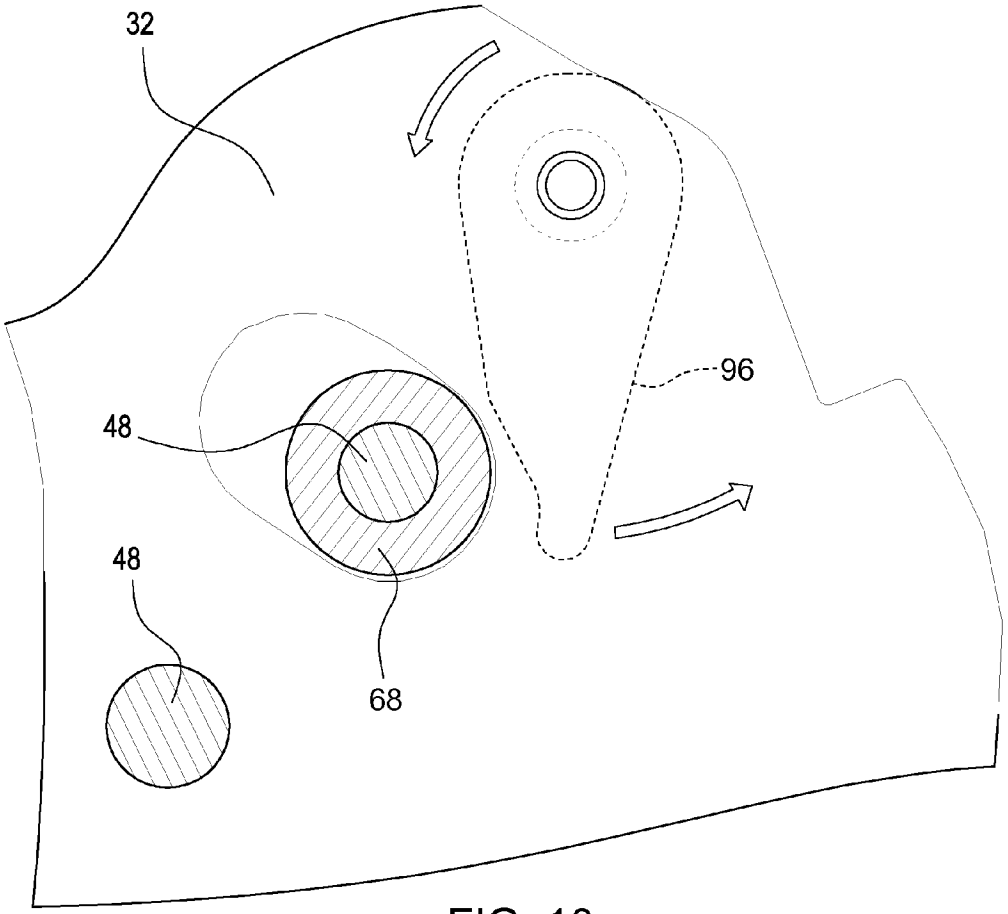
FIG. 10 is a schematic, transverse view of the lock on the tool carrier in the area of the setting up and holding devices in the locking position.
Figure 11:
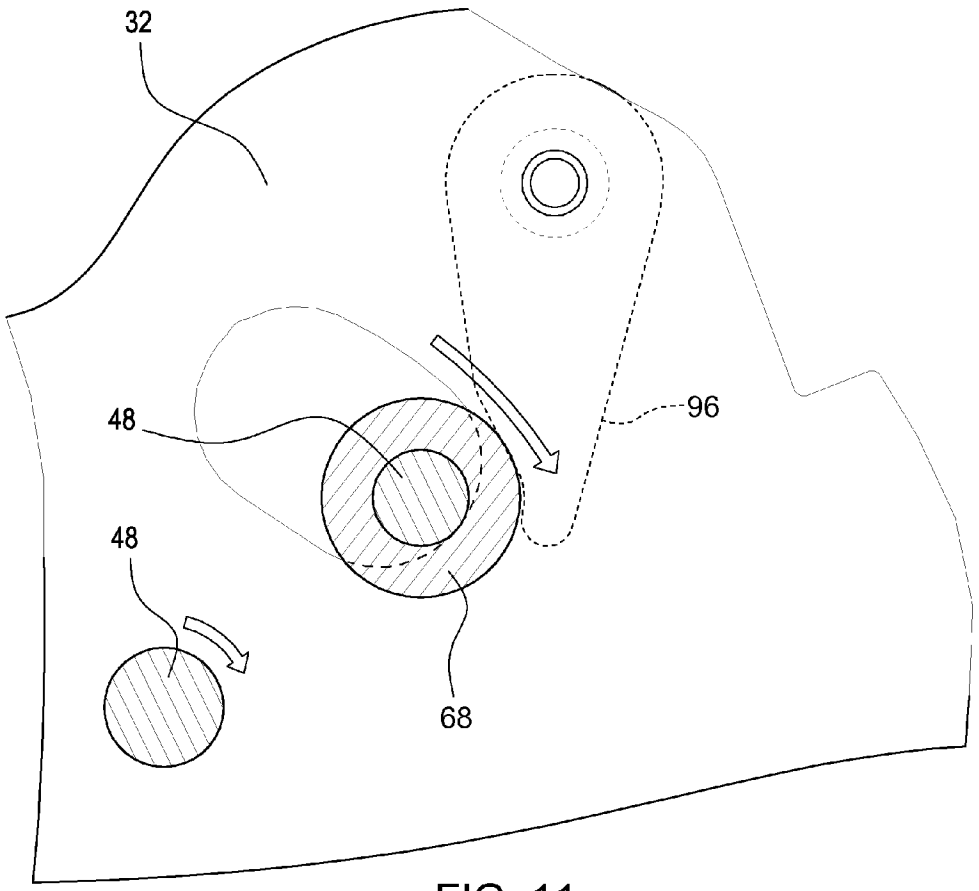
FIG. 11 is a schematic, transverse view of the lock on the tool carrier in the area of the setting up and holding devices in the unlocking position.
Figure 12:
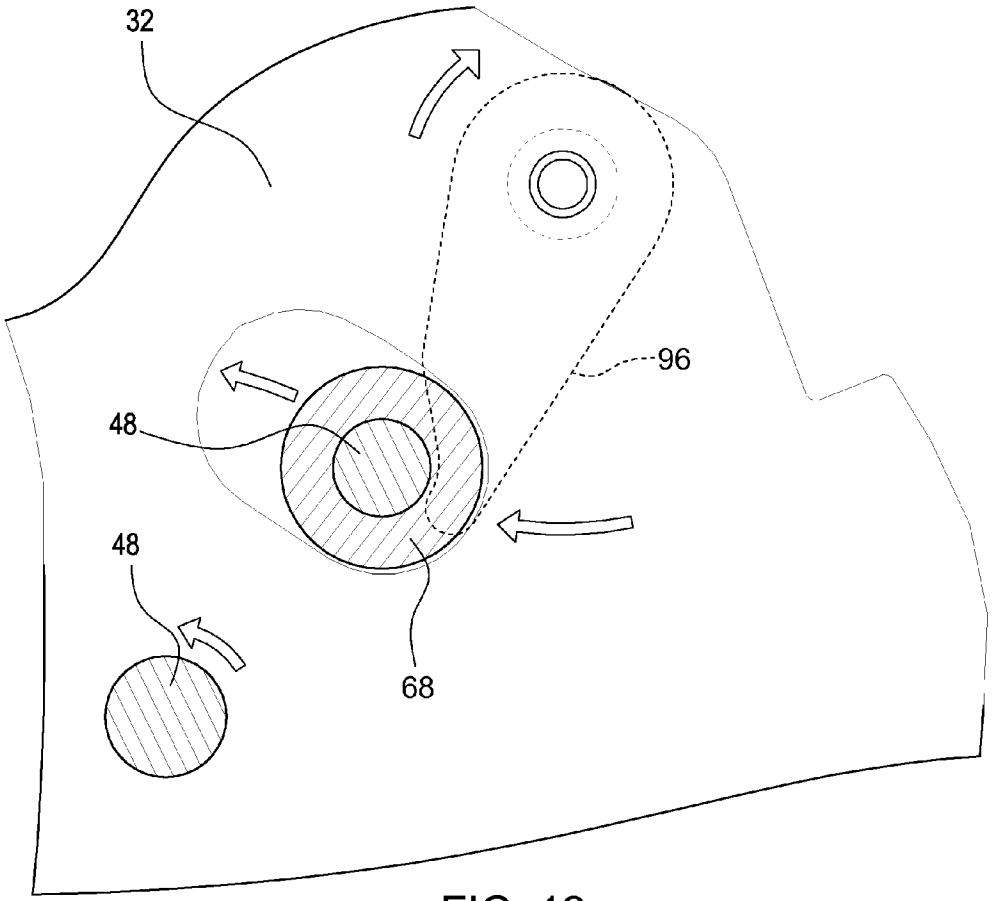
FIG. 12 is a schematic, transverse view of the lock on the tool carrier in the area of the setting up and holding devices in the pre-locking position.

The locking device 46 comprises a lock 48 which extends transverse to the tool carrier 18 and which is shown in detail in FIG. 8 and setting up and holding devices 50, which are shown in detail in FIG. 9.

The lock 48 is designed in the shape of a rod and has a handle 52, a first guiding and locking section 54 on the side of the handle, a second guiding and locking section 56, opposite the side of the handle, and a setting up and holding section 58. In its course from the setting up and holding section 58 to the opposite side of the tool carrier 18 or to the second guiding and locking section 56, the lock 48 has a course 60 that is bent in such a way that open ends 62, 64 of the lock 48 together point in a direction away from the handle 52 and are aligned with one another. Furthermore, a heel 66 is formed on the lock 48 in the area of the setting up and holding section 58. The heel 66 is formed here by an end of a tube 68, which is guided over a rod-shaped section 70 of the lock 48, on the side of the handle. The handle 52 is formed by a rod which is curved in the shape of a U and which has a short leg 72, a long leg 74, and a crosslink 76, wherein there is a connecting plate 78, which is firmly connected with the two legs 72, 74 of the handle, wherein the long leg 74 extends through a borehole in the connecting plate 78 and forms the first guiding and locking section 54 of the lock 48 on the side of the handle. Between the legs 72, 74, the connecting plate 78 is connected with the setting up and holding section 58 or the tube 68. The crosslink 76 is used to grip the lock 48, especially if it is brought from a locking position into an unlocking position. Between the curved course 60 of the lock 48 and the heel 66, a stop 80 has been constructed on the lock 48; a coil spring 82, pushed via the (rod-shaped) lock 48, is supported on it and extends in the direction of the handle 52. On the end of the coil spring 82, a disk 84 is supported on the lock 48 so it can be displaced, wherein the disk 84 has an inside borehole which is larger than the diameter of the lock 48 but is smaller than the diameter of the coil spring 82. The disk 84 is used as a movable stop which, with an activation of the lock 48 with the tool carrier frame 22, is made to engage, in particular, with the profile plate 30 on the side of the handle. As a consequence of this, the coil spring 82 is compressed against the stop 80 and a pretension force is produced on the lock 48, which presses the lock 48 into a locking position in accordance with FIG. 4. As already mentioned, the lock 48 is guided or supported, in a displaceable manner, into the boreholes 36 of the support plate 38, into the boreholes 40, 42 of the profile plates 30, 32, and into the borehole 42 of the profile plate 44 on the side of the handle, on its first guiding and locking sections 54, 56, on both sides of the tool carrier frame 22. The boreholes 36, 40, 42, 44 provided for the guiding or support of the lock 48 have a diameter which is slightly larger than an outside diameter of the lock 48, so that the lock 48 is transversely displaceable (that is, in the transverse direction to the front loader or in the direction of the width of the tool carrier 18), but is radially fixed. The setting up and holding section 58 of the lock 48 is also guided through the profile plates 30, 32, 34 on the side of the handle. To this end, boreholes 86, 88, 90, which have a larger diameter than the outside diameters formed on the setting up and holding section 58 of the lock 48, are provided, with the background that the setting up and holding section 58 of the lock 48 has radial clearance in its guidance through the boreholes 86, 88, 90 and can be displaced radially or swiveled around a longitudinal axis 92 of the first guiding and locking section 54, as is particularly clear in FIGS. 10 to 12.

Moreover, the locking device 46 comprises setting up and holding devices 50, which are used for the displacement and holding of the setting up and holding section 58 of the lock 48, as is clear in the following. The setting up and holding devices 50 comprise a rotary lever 94, a second rotary lever 96, and a rotation axle 98 (or swivel axle), on which the rotary levers 94, 96 are supported in a nonrotating manner, where the two rotary levers 94, 96 are firmly connected to one another. The rotation axle 98 is supported so it can swivel between the profile plates 30 and 32, wherein the position of the rotation axle 98 and the shape and size of the rotary levers 94, 96 are selected so that with a swiveling of the setting up and holding devices 50 around the rotation axle 98, the first rotary lever 94 protrudes, with its end 100, into the tool holding area 20', formed between the profile plate 30 and the support plate 38 and the second rotary lever 96 with its end 102 between the profile plate 30 on the side of the handle and the support plate 38, also on the side of the handle, can engage with the setting up and holding section 58 of the lock 48. On the first rotary lever 94, a spring 104, connected with the profile plate 30 on the side of the handle, acts and by this means, a pretension is produced on the setting up and holding devices 50, as soon as the first rotary lever 94, with reference to FIG. 9, is deflected, in a counterclockwise manner, around the rotational axle 98.

Figure 4:
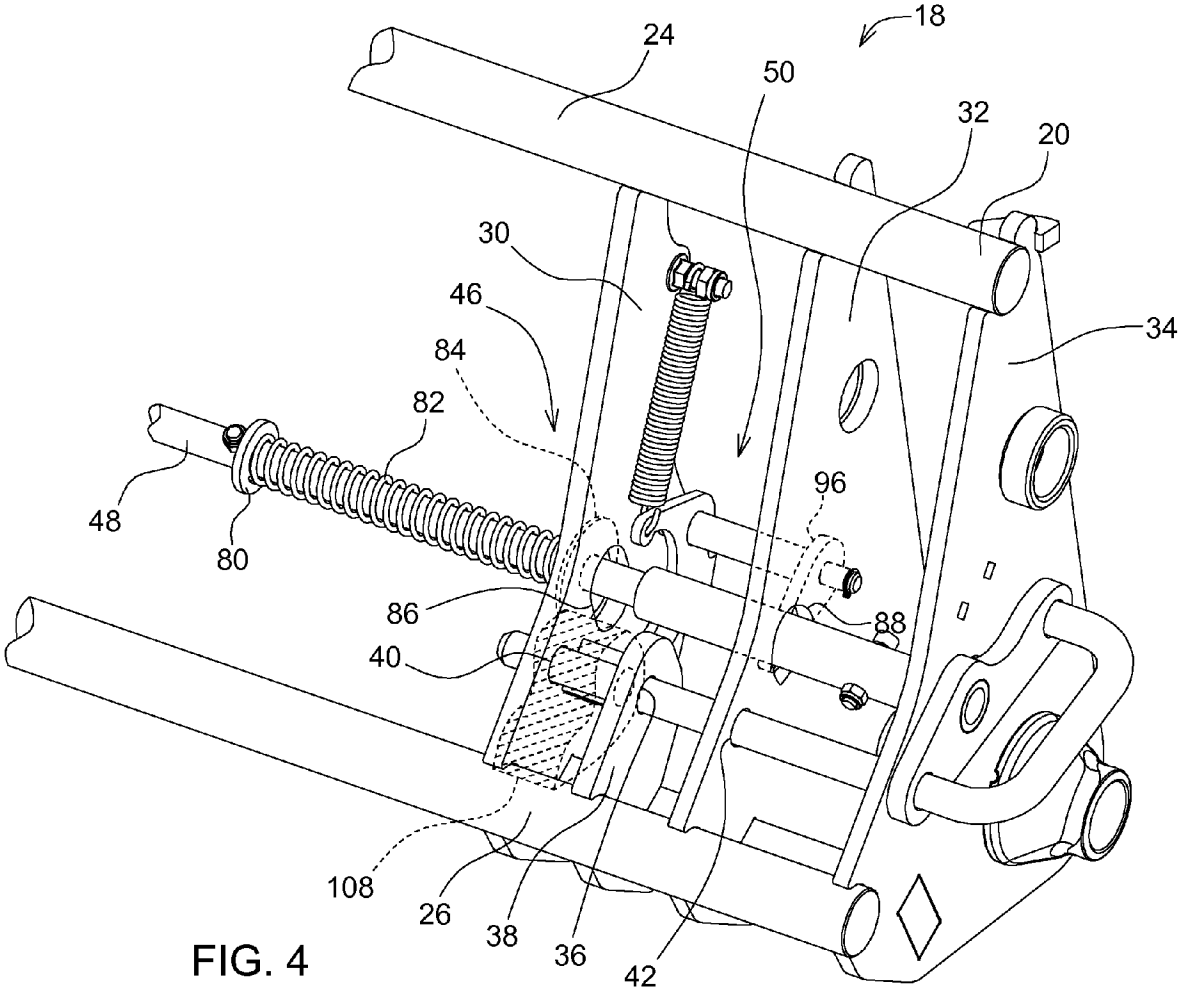
FIG. 4 is a schematic, perspective front view of the tool carrier from FIG. 1 in a partial representation with a locking device in the locking position.
Figure 5:
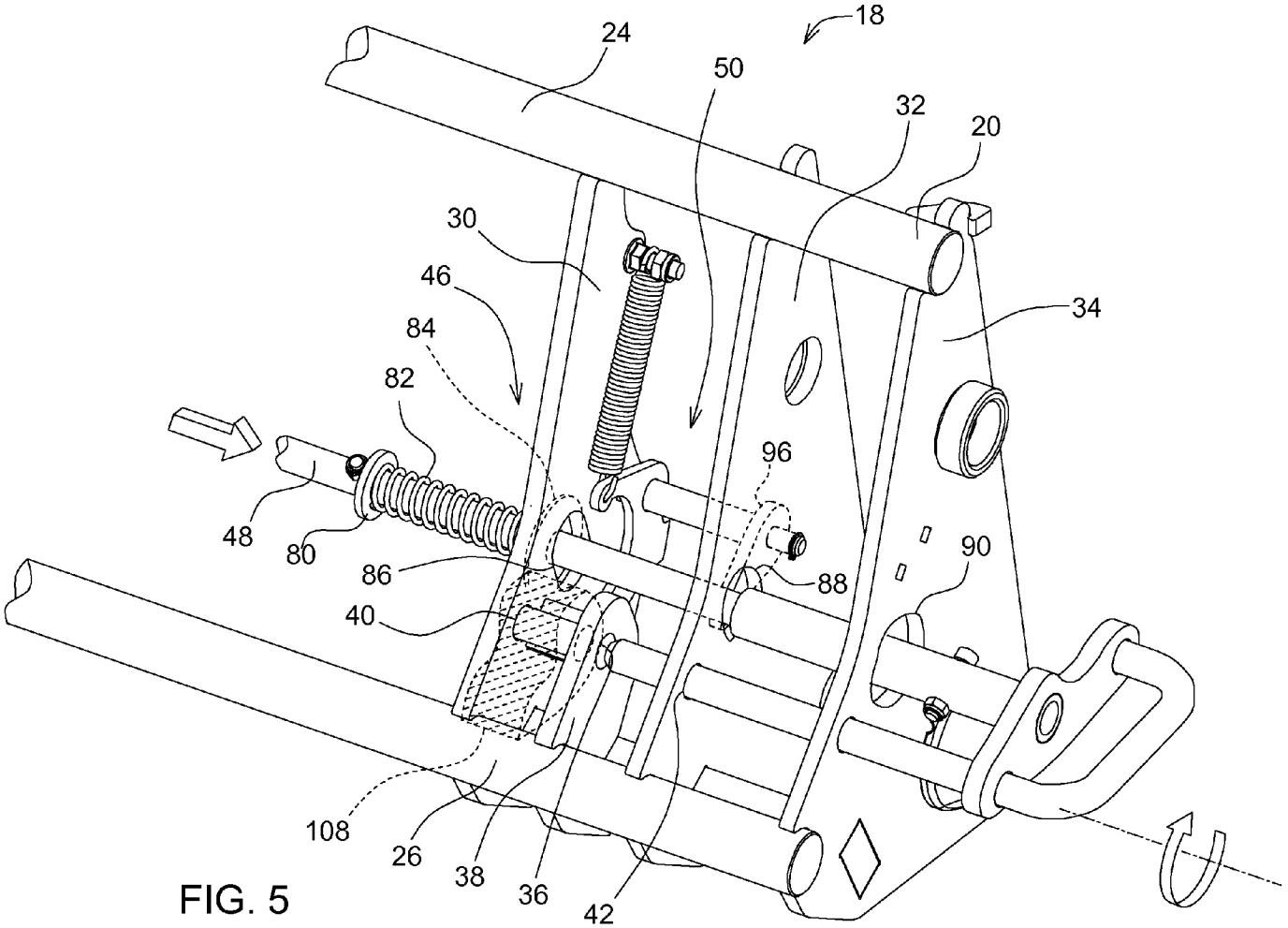
FIG. 5 is a schematic, perspective front view of the tool carrier from FIG. 1 in a partial representation with the locking device in an unlocking position.
Figure 6:
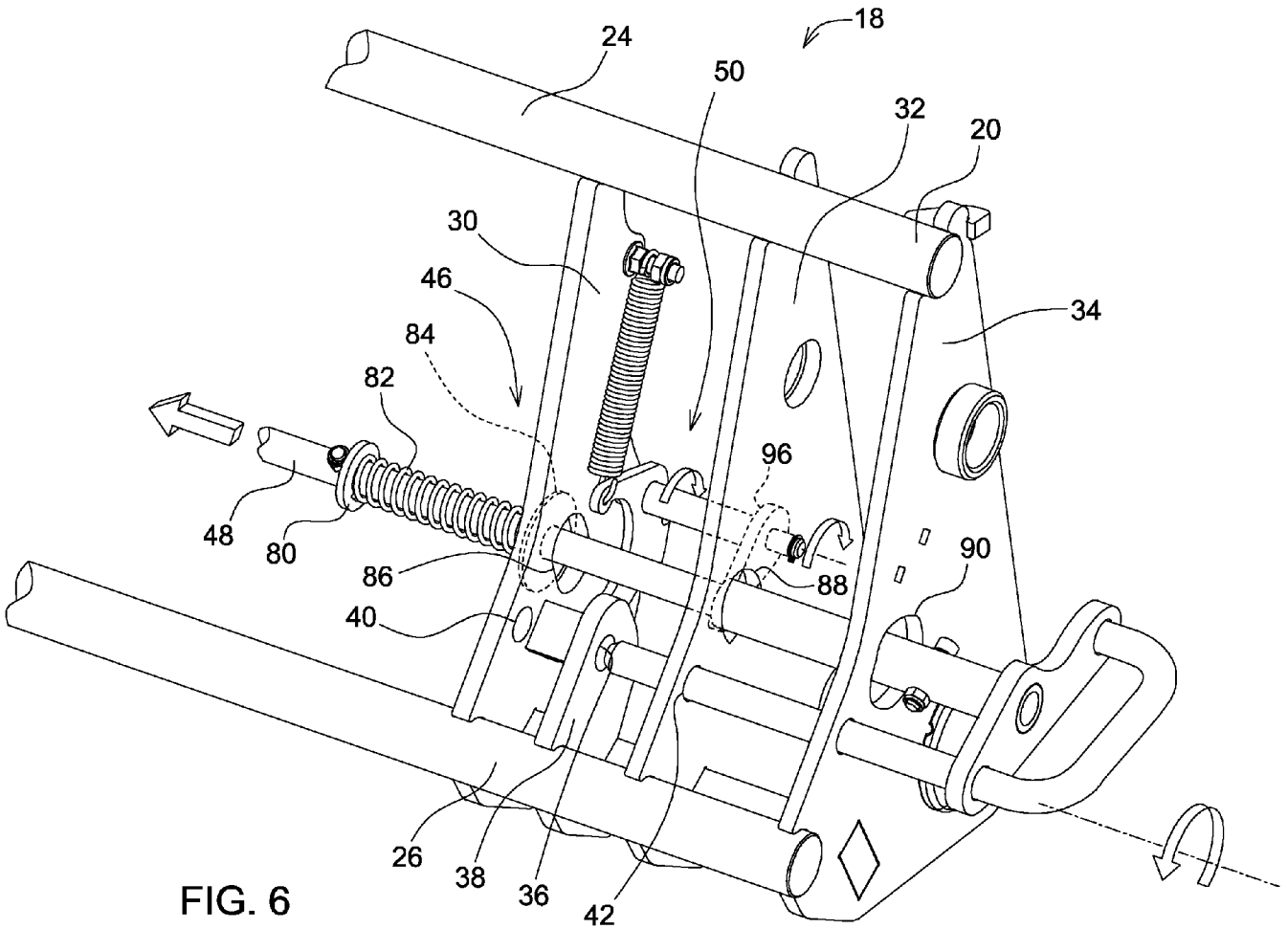
FIG. 6 is a schematic, perspective front view of the tool carrier from FIG. 1 in a partial representation with the locking device in a pre-locking position.
Figure 7:
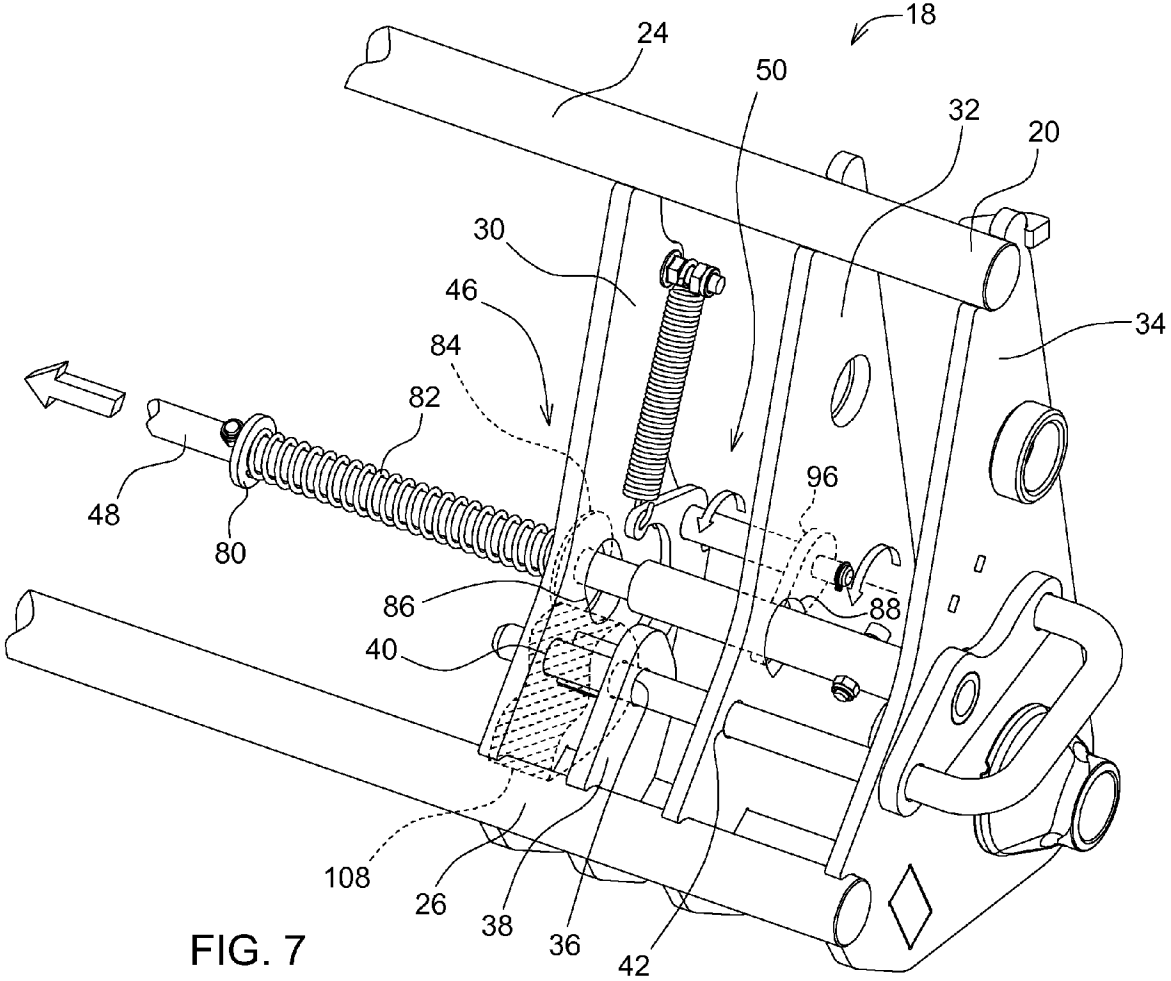
FIG. 7 is another schematic, perspective front view of the tool carrier from FIG. 1 in a partial representation with the locking device in the locking position.

Proceeding from a change of a tool—namely, an unlocking and placing of a tool by the tool carrier 18 and a subsequent renewed setting up and locking of a tool on the tool carrier 18, the functionality of the tool carrier 18 is described as follows:

For the placing of the tool, the lock 48 is initially still in its locking position, in accordance with FIG. 4 and FIG. 7, wherein the fastening lug 108 of the tool 21 engages with the lock 48. Proceeding from this, the lock 48 on the handle 52 is manually brought into the unlocking position by an operator—that is, it is released or moved or pulled out of its locking position. During the pulling out of the lock 48, the disk 84 impacts the inside of the profile plate 30 on the side of the handle, wherein the lock 48 is pretensioned by a continued pulling out. The lock 48 is thereby pulled out under increasing pretension until the heel 66 passes from the center of the tool carrier 18 through the borehole 88 of the profile plate 32 on the side of the handle (as is shown in FIG. 5). By a slight swiveling of the lock 48 around the longitudinal axis 92 (from the position shown in FIG. 10 into the position shown in FIG. 11), the heel 66 is pushed over the edge of the borehole 88 and there brought to the stop on the handle side of the profile plate 32. By the pretension applied on the lock 48, the lock is pressed, on its heel 66, against the edge of the borehole 88 and held in the unlocking position described here (see, in particular, FIG. 5 and FIG. 11).

In order to suspend or place the now unlocked tool 21 from the tool carrier 18, the tool carrier 18 must be released from the suspension hook 106. The tool carrier 18 is thereby swiveled in such a manner that an underside of the tool carrier 18 is removed from the tool 21 so that the fastening lugs 108 protruding on the tool carrier 18 into the tool holding areas 20', are moved out of the tool holding areas 20'. After the moving out of the fastening tools 108, the tool carrier 18 can be moved, without hindrance, from the suspension hook 106. During the moving out of the fastening lugs 108 from the tool holding areas 20', the engagement of the fastening tool 108 on the side of the handle with the end 100 of the first rotary lever 94 is simultaneously triggered. The blockade of the pretensioned setting up and holding devices 50, produced with the set-up tool 21 by the fastening lug 108 on the side of the handle, is thus cancelled. As a result of this, the rotary levers swivel, under pretension, in the direction of the lock 48, wherein the second rotary lever 96 presses against the lock 48 under pretension and triggers a swiveling movement of the lock 48 around the longitudinal axis 92, whereupon the lock 48 is moved out of its position (heel 66 is next to the profile plate 32 on the edge of the borehole 88, in accordance with FIGS. 5 and 11). The pretension by the coil spring 82, which continues to act on the lock 48, now pulls the lock 48 in the direction of the center of the tool carrier 18, until it once again encounters the stop with its heel 66—on the side surface of the second rotary lever 96, as is shown particularly in FIGS. 6 and 12. The lock 48 now assumes a spring-pretensioned locking position and is held or blocked only by the second rotary lever 96, whereas the tool carrier 18 was completely separated from the tool 21 or the tool 21 was placed by the tool carrier 18.

In this state (lock 48 in the pre-locking position), the tool carrier 18 is prepared to hold a tool 21, wherein the holding of a tool 21 is carried out as follows.

With the suspension hook 106 formed on the tool 21, the tool 21 is initially suspended on the tool holding areas 20 of the tool carrier 18. This occurs, as a rule, by moving the front loader 14 to the tool 21, wherein the tool carrier 18 is hydraulically steered or moved under the suspension hook 106 and is so completely set up on the tool 21 that the fastening lug 108, formed on the tool 21, projects into the tool holding areas 20, 20'. The first rotary lever 94, projecting into the tool holding area 20', formed on the side of the handle, is activated by the fastening lug 108 on the side of the handle in such a way that the first rotary lever 94 is pressed away by the lock 48. At the same time, the second rotary lever 96, also blocking or holding the lock 48 in this way, is moved away by the lock 48, so that the lock 48 is released by the second rotary lever 96 and is moved in the direction of the center of the tool carrier 21. The lock 48 thereby assumes its locking position automatically—that is, independently, wherein the two ends 62, 64 or the guiding and locking sections 54, 56 of the lock 48 engage with the fastening lug 108 and boreholes 36, 40, 42 on the tool carrier and lock the tool (FIG. 7).

While the above describes example embodiments of the present disclosure, these descriptions should not be viewed as limiting. Rather, there are several variations and modifications which may be made without departing from the scope of the present invention as defined in the appended claims.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A tool lock comprising:

a tool carrier comprising an upper cross brace and a lower cross brace connected by at least one profile plate and at least one support plate, wherein the area between the at least one profile plate and the at least one support plate define a tool holding area for engaging and locking a tool comprising a fastening lug;

a lock comprising a handle for the manual movement of the lock from the locked position to the unlocked position and a first guiding and locking section connected to a second guiding and locking section, wherein the second guiding and locking section comprises a spring connected to a disk for engaging the tool carrier and a heel; and a setting up and holding device supported on the tool carrier comprising a first rotary lever connected to a second rotary lever about a rotation axle and a spring coupled to the tool carrier and to the first rotary lever, wherein the first rotary lever further comprises an end configured to engage the fastening lug of the tool and the second rotary lever further comprises an end configured to engage the heel so as to maintain the lock in an unlocked position.

2. The tool lock of claim 1, wherein the second rotary lever further comprises an end configured to engage the heel so as to maintain the lock in an unlocked position.

3. The tool lock of claim 1, wherein the at least one profile plate and the at least one support plate each further comprise a borehole for guiding the lock.

4. The tool lock of claim 1, wherein the area between the at least one profile plate and the at least one support plate define a tool holding area for engaging and locking a tool.

5. The tool lock of claim 1, wherein the handle further comprises two legs connected to a crosslink on one end and connected to a connecting plate on the other end.

6. The tool lock of claim 5, wherein the second guiding and locking section extends through a borehole in a connecting plate to form one of the two legs.

7. The tool lock of claim 6, wherein the first guiding and locking section is connected on the opposite side of the connecting plate from the two legs.

8. The tool lock of claim 1, wherein the first rotary lever further comprises an end activated by the tool to move lock into the locked position.

9. A method for automatically locking a tool to a loader comprising:

pulling a handle of a lock to place a setting up and holding device supported on a tool carrier in an unlocked position;

maneuvering the tool carrier to engage a suspension hook of a tool comprising a fastening lug;

further maneuvering the tool carrier so that the fastening lug interacts with the setting up and holding device such that the lock secures the tool to the tool carrier in a locked position;

wherein the lock comprises a first guiding and locking section connected to a second guiding and locking section, wherein the second guiding and locking section comprises a spring connected to a disk for engaging the tool carrier and a heel to maintain the lock in a locked position;

wherein the setting up and holding device comprises a first rotary lever connected to a second rotary lever about a rotation axle and a spring coupled to the tool carrier frame and to the first rotary lever;

wherein the fastening lug interacts with an end of the first rotary lever to rotate the first rotary lever about the rotation axle thereby rotating the second rotary lever and in turn releasing the heel to secure the tool to the tool carrier.

10. The method of claim 9, wherein the tool carrier comprises a tool carrier frame including an upper cross brace and a lower cross brace connected by at least one profile plate and at least one support plate.

* * * * *